US011208131B2

(12) United States Patent
Young

(10) Patent No.: US 11,208,131 B2
(45) Date of Patent: Dec. 28, 2021

(54) SYSTEMS AND METHODS FOR CONTROLLING RAILROAD HIGHWAY CROSSING FLASHERS

(71) Applicant: BNSF Railway Company, Fort Worth, TX (US)

(72) Inventor: Ralph Young, Osawatomie, KS (US)

(73) Assignee: BNSF Railway Company, Fort Worth, TX (US)

( * ) Notice: Subject to any disclaimer, the term of this patent is extended or adjusted under 35 U.S.C. 154(b) by 289 days.

(21) Appl. No.: 16/400,017

(22) Filed: Apr. 30, 2019

(65) Prior Publication Data

US 2020/0346676 A1 Nov. 5, 2020

(51) Int. Cl.

| | |
|---|---|
| ***H05B 45/10*** | (2020.01) |
| ***B61L 29/28*** | (2006.01) |
| ***B61L 13/00*** | (2006.01) |
| ***B61L 9/04*** | (2006.01) |
| ***H05B 45/44*** | (2020.01) |

(52) U.S. Cl.

CPC ..... *B61L 29/288* (2013.01); *B61L 9/04* (2013.01); *B61L 13/002* (2013.01); *H05B 45/10* (2020.01); *H05B 45/44* (2020.01)

(58) Field of Classification Search

CPC ..... B61L 29/04; B61L 29/22; B61L 29/28; B61L 29/32; B61L 29/246; B61L 29/288; B61L 9/04; B61L 13/002; B61L 29/24; H05B 45/10; H05B 45/44; H05B 45/30; H05B 45/50; Y10S 320/36; G08B 5/38

See application file for complete search history.

(56) References Cited

U.S. PATENT DOCUMENTS

| | | | | |
|---|---|---|---|---|
| 4,934,633 | A * | 6/1990 | Ballinger | B61L 29/28 246/125 |
| 5,808,545 | A * | 9/1998 | Brueggemann | B60Q 1/382 315/200 A |
| 7,075,427 | B1 * | 7/2006 | Pace | B61L 23/06 246/125 |
| 7,164,892 | B2 * | 1/2007 | Derome | B61L 29/22 340/902 |
| 7,688,222 | B2 * | 3/2010 | Peddie | G08G 1/096783 340/905 |
| 9,018,850 | B2 * | 4/2015 | Nguyen | H05B 45/30 315/247 |
| 9,193,367 | B2 * | 11/2015 | Hilleary | B61L 29/246 |
| 10,556,604 | B2 * | 2/2020 | Plant | B61L 1/185 |
| 10,883,705 | B2 * | 1/2021 | Fox | B61L 29/04 |

* cited by examiner

*Primary Examiner* — Haissa Philogene

(74) *Attorney, Agent, or Firm* — Enrique Sanchez, Jr.; Whitaker Chalk Swindle & Schwartz, PLLC

(57) ABSTRACT

A railroad crossing warning circuit includes a lamp and a signal generator for generating a first signal of a selected frequency. Divider circuitry divides the frequency of the signal to generate second signal at a flashing frequency. A switch responsive to the second signal controls current flow through the lamp and cause the lamp to flash at the flashing frequency.

20 Claims, 6 Drawing Sheets

SYSTEMS AND METHODS FOR CONTROLLING RAILROAD HIGHWAY CROSSING FLASHERS

FIELD OF INVENTION

The present invention relates in general to railroad operations and in particular to systems and methods for controlling railroad highway crossing flashers.

BACKGROUND OF INVENTION

In the railroad industry, a number of different monikers are used to refer to locations where the tracks of a rail line cross a road or highway, including "highway crossing", "railway crossing", "grade crossing", "level crossing", and "railway crossing", among others. For purposes of the present discussion, the term "highway crossing" will be used, although any of the terms commonly used in the railroad industry will apply equally well to the following discussion. Whatever term is used, highway crossings are familiar worldwide.

Highway crossings provide a significant hazard to vehicles and pedestrians on the intersecting highway or road, as well as to the trains and their crews, passengers, and cargo. In particular, a moving train cannot quickly stop or significantly reduce its speed in response to an obstacle on the track, such as a pedestrian or vehicle, given its mass. Hence, a ubiquitous strategy has developed over the many years in which the railroads have operated, namely, maintaining clear tracks in advance of oncoming trains.

Active highway crossings are very familiar, at least to those living in the United States. Generally, an electrical track circuit, which transmits either a DC or AC signal through a circuit formed by the pair of rails of the track itself, detects the wheels of a train entering the block or section of track on the approach to the highway crossing. Depending on the speed of the train and its distance from the highway crossing, an associated electrical control system then lowers crossing gates, activates flashing lights, and/or activates bells, depending on the particular system configuration. The control system is typically maintained within a housing or cabinet in the vicinity of the highway crossings.

In conventional highway crossing flasher systems, all of the flashers are typically controlled by a common electrical control circuit. Consequently, the failure of that common electrical control system causes all the flashers to stop flashing. A similar problem exists with regards to the flashing lights on the crossing gates: a failure of the common electrical control circuit causes all the lights on the gate or gate to cease flashing. In both cases, safety at the highway crossing can be significantly compromised.

SUMMARY OF INVENTION

One embodiment of the principles of the present invention is a railroad crossing warning circuit, which includes a lamp and a signal generator for generating a first signal of a selected frequency. Divider circuitry divides the frequency of the signal to generate second signal at a flashing frequency. A switch responsive to the second signal controls current flow through the lamp and cause the lamp to flash at the flashing frequency.

Another embodiment is a railroad crossing flasher system, which includes first and second lamps, first control circuitry for controlling flashing of the first lamp, and second control circuitry for controlling flashing of the second lamp. The first control circuitry includes a first signal generator for generating a first base signal having a frequency, a first frequency divider for dividing the frequency of the first base signal to generate a first flashing signal having a flashing frequency, and a switch responsive to the first flashing signal for controlling current flow through the first lamp to selectively cause the first lamp to flash at the flashing frequency. The second control circuitry includes a second signal generator for generating a second base signal having a frequency, a second frequency divider for dividing the frequency of the second base signal to generate a second flashing signal having the flashing frequency, and a second switch responsive to the second flashing signal for controlling current flow through the second lamp to selectively cause the second lamp to flash at the flashing frequency. The first and second flashing signals are out-of-phase such that the first and second lamps alternately flash.

A further embodiment of the present principles is a crossing gate lamp control system including first and second crossing gate lamps. A signal generator generates a first signal of a selected frequency and divider circuitry divides the frequency of the first signal to generate first and second complementary output signals each at a flashing frequency. A first switch, which is responsive to the first complementary output signal, controls current flow through the first crossing gate lamp and causes the first crossing gate lamp to flash at the flashing frequency. A second switch, which is responsive to the second complementary output signal, controls current flow through the second crossing lamp and causes the second crossing gate lamp to flash at the flashing frequency alternately with the flashing of the first crossing gate lamp.

Embodiments of the present principles advantageously ensure that a failure of a single controlling circuit or element does not cause all the lamps of a railroad highway crossing warning system to fail. In other words, failures are isolated to a single, or at least a small number, of lamps. In addition, the operations of each pair of lamps, as well as the operations of all of the lamps in the crossing flasher system, are synchronized. These principles are applicable to both flashers, as well as the flashing lights on crossing gates.

BRIEF DESCRIPTION OF DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
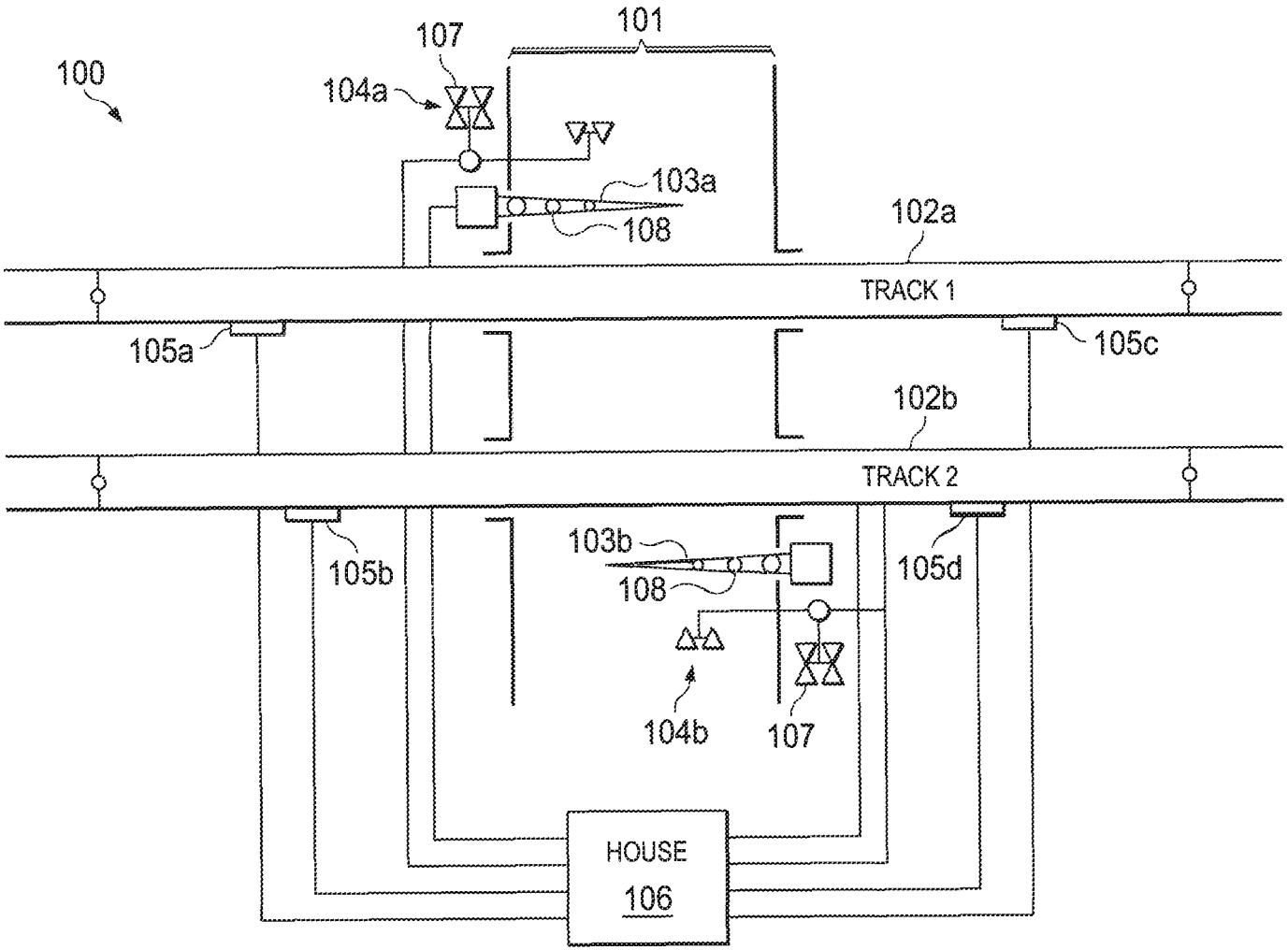
FIG. 1 is a diagram of a representative highway crossing, where two railroad tracks cross a roadway, suitable for describing a typical application of a crossing lamp flasher controller embodying the principles of the present invention.

FIG. 1 is a diagram of an exemplary highway crossing 100 suitable for demonstrating a typical application of a crossing lamp flasher control circuit (XLF) embodying the principles of the present invention. As shown in FIG. 1A, a two-way highway or roadway 101 crosses a pair of parallel tracks 102*a* (Track 1) and 102*b* (Track 2). In actual practice, the number and direction of the lanes of roadway 101, as well as the number and/or orientation of tracks 102, may vary depending on the particular crossing site. Tracks 102 may be, for example, railroad or light railway tracks.

Highway crossing 100 is equipped with conventional crossing gates 103*a*-103*b*), flasher systems 104*a*-104*b*, train motion detectors 105*a*-105*d*, and a housing 106 holding conventional highway crossing control systems such as a crossing controller, an event recorder, a cellular communications system, back-up batteries, and battery chargers. Audible warning components, such as bells, may also be provided.

Typically, there are a minimum of eight (8) flashers per highway crossing disposed in pairs. At exemplary highway crossing 100, flasher systems 104*a*-104*b* each include three pairs of flashers 107, with two pairs disposed back-to-back on a vertical support and one pair supported by an gantry over the roadway 101 and facing oncoming road traffic. The flashers (lamps) of each pair of flashers 107 alternately flash. Each gate 103 includes three (3) lamps 108, with the tip lamps constantly on when the gate is lowered and the inner pair of lights alternately flash.

Figure 2:
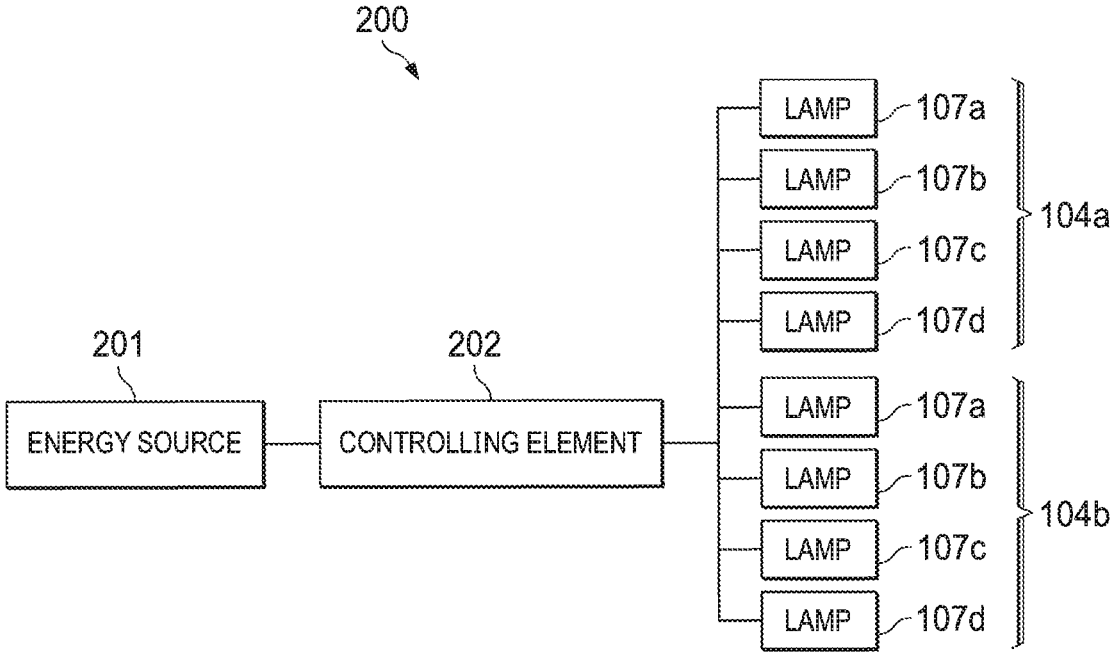
FIG. 2 (PRIOR ART)
FIG. 2 is a diagram of a conventional configuration of a system for controlling a set of highway crossing flasher lamps.

FIG. 2 illustrates a conventional system 200 for controlling railroad crossing flashers. System 200 includes an energy source 201, which may be a power supply or backup batteries, and a controlling element 202, which could be a set of relays or electronic controllers, as known in the art. Generally, when a train is approaching the crossing, a least one relay, typically the EOR relay, cycles its contacts at a predetermined rate to control flashers 108. (In the examples discussed herein, flashers 107*a* and 107*b* of each flasher system 104*a* or 104*b* form a pair of alternating flashers and flashers 107*c* and 107*d* form another pair of alternating flashers.)

One significant disadvantage of conventional flasher control system 200 arises from the use of a common controlling element 202. Specifically, a single fault failure mode of common controlling element 202 results in a failure of all of the lamps of the crossing system (e.g., all lamps 107 of FIGS. 1 and 2). This type of failure is designated by the Federal Railroad Administration (FRA) as an "activation failure".

Figure 3A:
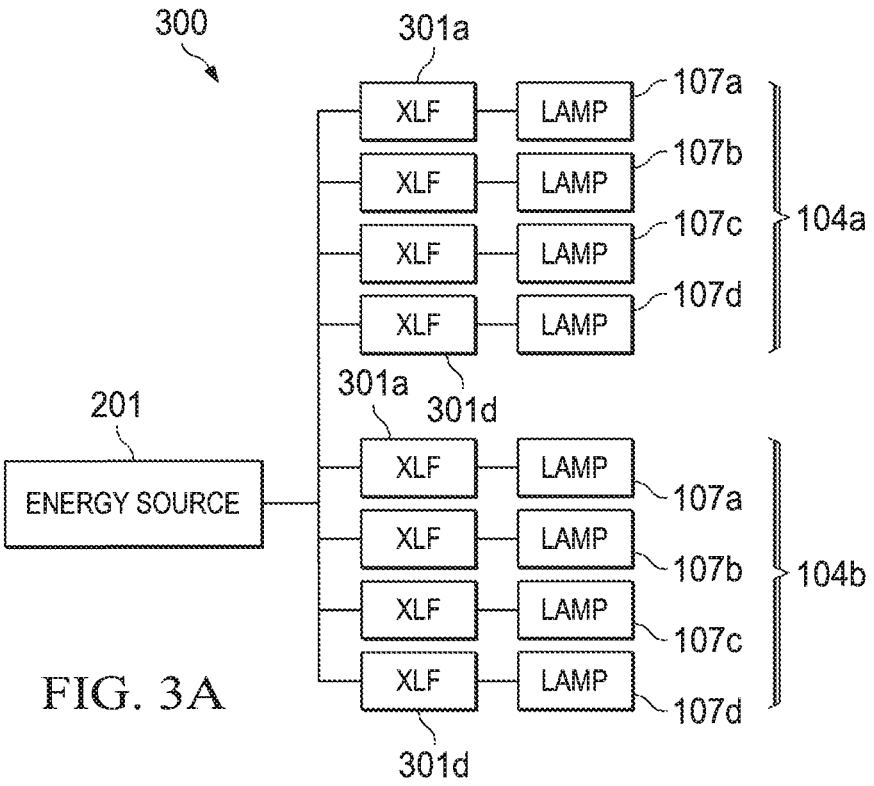
FIG. 3A is a block diagram of a system for controlling a set of highway crossing flasher lamps according to a representative embodiment of the principles of the present invention.

An exemplary embodiment of the principles of the present invention is flasher control system 300 of FIG. 3A. Generally, flasher control system 300 includes one crossing lamp flasher circuit (XLF) 301, which is coupled to energy source 201, for each lamp 107. Each XLF circuit 301 is preferably disposed within the flasher head associated with each lamp 107, although it could be located elsewhere, for example, within house 106 (FIG. 1). Advantageously, if an XLF 301 fails, only one lamp 107 stops flashing, while the remaining lamps 107 continue to flash normally.

Another significant advantage of flasher control system 300 is that all lamps are synchronized. As discussed further below, all XLFs 301 are activated when power is applied by energy source 201. The leading edge ("pulse") starts XLFs 301 substantially simultaneously, which synchronizes the alternating flashes of each pair of XLFs 301, as well as the operation of all XLFs 301 in system 300.

Figure 3B:
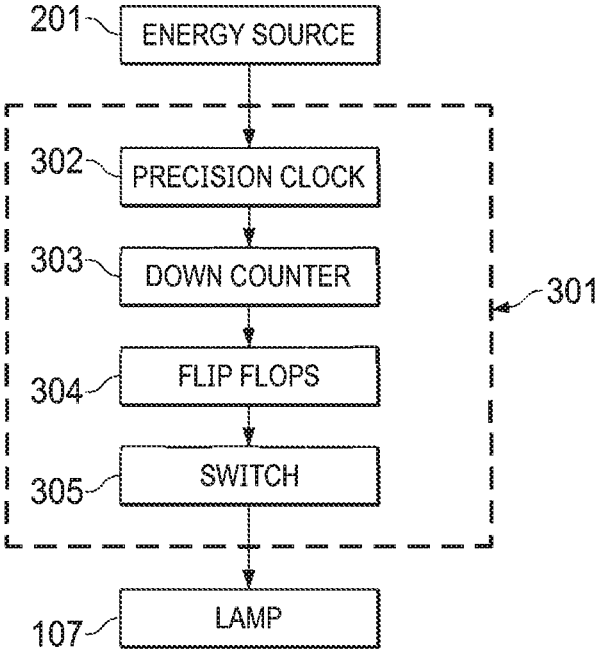
FIG. 3B is a more detailed block diagram of a representative crossing flasher lamp controller circuit (XLF) suitable for use in the system of FIG. 3A.

A block diagram of a representative XLF 301 is shown in FIG. 3B. In this example, energy source 201 (e.g., a 12-18V DC power supply) drives a precision clock signal generator 302, which provides a clock signal of a predetermined fixed frequency. The frequency of the clock signal is divided down by a down counter 303 and a set of flip-flops 304, which toggle a switch 308 and cause the corresponding lamp 107 to flash at a predetermined frequency. In particular, each set of flip-flops 304, selectively outputs one of two 180 degree out of phase signals to switch 305, which allows the lamps 107 of each pair of lamps 107 to alternately flash. For example, XLF 301*a* would provide a signal of a given phase to flash lamp 107*a* at the given frequency, while XLF 301*b* would provide a signal 180 degrees out of phase to that provided by XLF 301*a* to alternately flash lamp 107*b* at the given frequency.

The principles of the present invention are not limited to embodiments using precision clock signal generator 302, down counter 303, and/or flip-flops 304. In alternate embodiments, other circuits or components may be used, such as microcontrollers, timers, or other circuits suitable for generating synchronized control signals.

One particular exemplary circuit suitable for use as an XLF 301 is shown in FIG. 3B. In this example, precision clock signal generator 302 generates a 32.768 kHz base frequency clock signal from a 32.768 kHz crystal. The frequency of the 32.768 kHz clock signal is then divided-down by a 14-bit counter 403 (CD4040) to 1 Hz. (In alternate embodiments, a different base frequency maybe selected, along with a counter of a correspondingly different number of stages.) A first flip-flop 304*a* further divides the clock signal down to ½ Hz and a second flip-flop 304*b* divides the clock signal down to ¼ Hz, which is the flashing frequency. (In the embodiment of FIG. 3B, flip-flops 304*a* and 304*b* are J-K (CD4027) flip-flops, although in alternate embodiments other types of flip-flops may be used.)

Depending on the desired phase, either the Q or/Q output of flip-flop 304*b*, as selected by setting the jumper discussed below, drives the gate of a field effect transistor (FET) 305. In response, FET 305 switches the current through the corresponding lamp 107, which is represented by an LED in FIG. 3C, but which also could be a conventional lamp in other embodiments. The Q or/Q output of flip-flop 304*b* is selected using a jumper across terminals 306. For example, lamp 107*a* of flasher system 104*a* of FIG. 3A may be controlled using the Q output of flip-flop 304*b* of corresponding XLF 301*a* using a jumper across terminals 1 and 2. Then, lamp 107*b* of flasher system 104*a* of FIG. 3A may be controlled using the/Q output of flip-flop 304*b* of the corresponding XLF 301*b* using a jumper across terminals 2 and 3. (The principles of the present invention are not limited to the use of a jumper to select the Q or/Q output of flip-flop 304*b*. For example, a switch, transistor, or programmable element may also be used.)

Figure 3C:
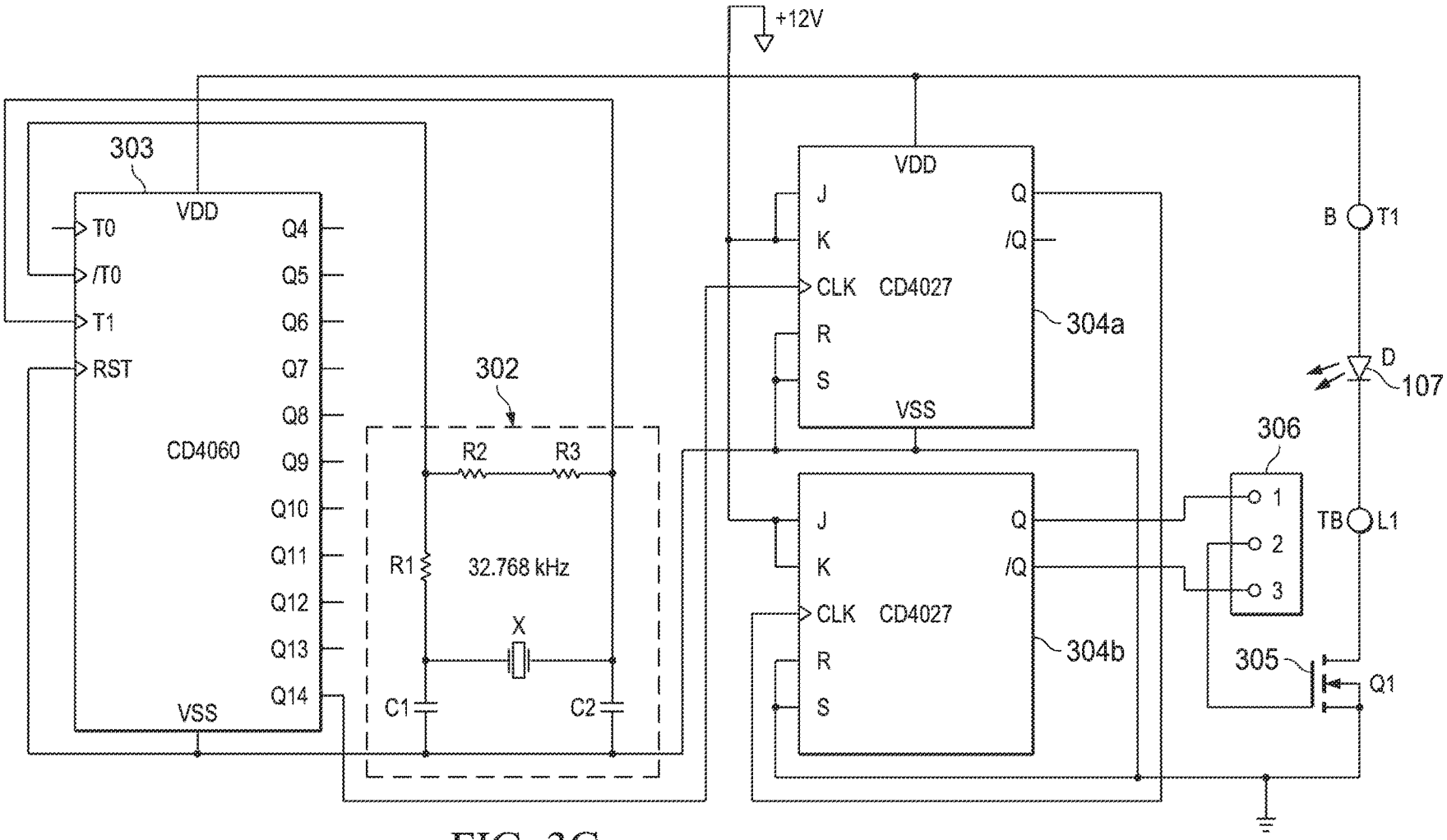
FIG. 3C is an electrical schematic diagram of a representative embodiment of the XLF of FIG. 3B.

In the embodiment of XLF 301 shown in FIG. 3C, the circuit starts when power from energy source 201 is applied. Specifically, precision clock signal generator 302 begins to oscillate and counter 303 begins to divide-down the frequency of the clock signal. In a system such as flasher control system 300, any phase differences due to differences in start-up times between the precision clock signal generators 302 of the different XLFs 301 will be small. After the clock signal frequency is divided down by the down counters 303 and flip-flops 304, any phase difference between the outputs of XLFs 301 will be very small and the lamps 107 are consequently synchronized.

The principles of the present invention are also applicable to controlling crossing gate lamps 108*a*-108*c* on each crossing gate 103*a* or 103*b*. In this case, the tip lamp 108*a* is steady-state on when the corresponding crossing gate 103 is lowered, while the corresponding lamps 108*b* and 108*b* alternately flash.

Figure 4A:
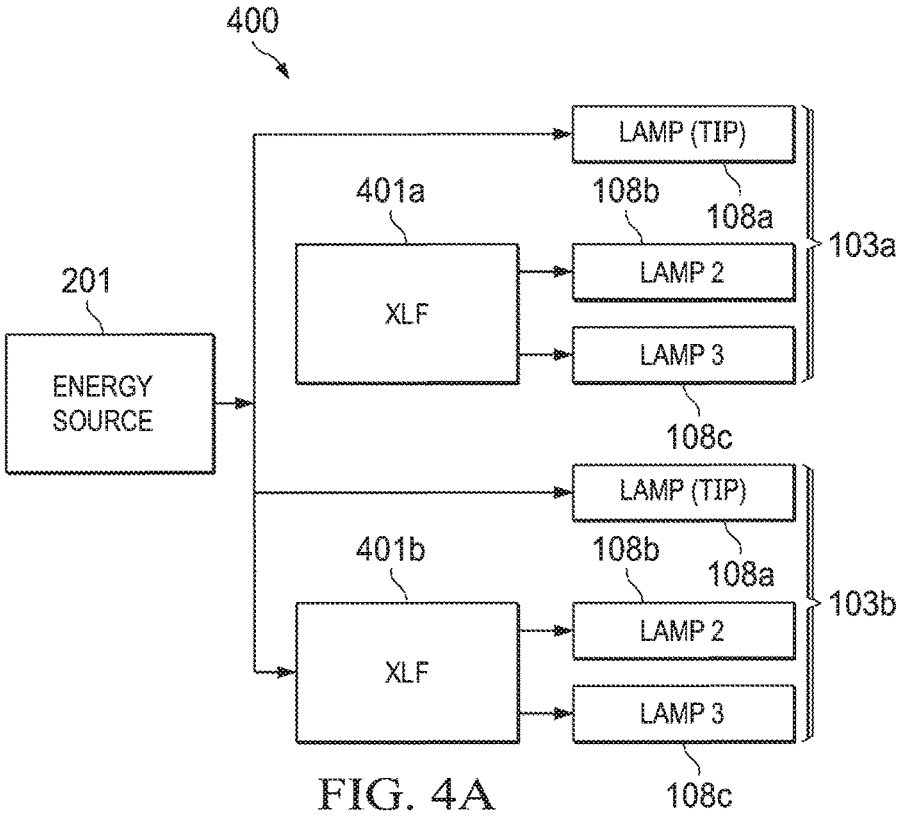
FIG. 4A is a block diagram of an exemplary system for controlling a set of highway crossing gate lamps according to the principles of the present invention.

As shown in FIG. 4A, tip lamps 108*a* of both crossing gates 103*a* and 103*b* are supplied directly from energy source 201 when crossing gates 103*a*-103*b* are down. Flashing lamps 108*b* and 108*c* of crossing gate 103*a* are controlled by an XLF 401*a* and flashing lamps 108*b* and 108*c* of crossing gate 103*b* are controlled by an XLF 401*b*. If one of XLF 401*a* or XLF 401*b* fails, the other will continue to operate.

Figure 4B:
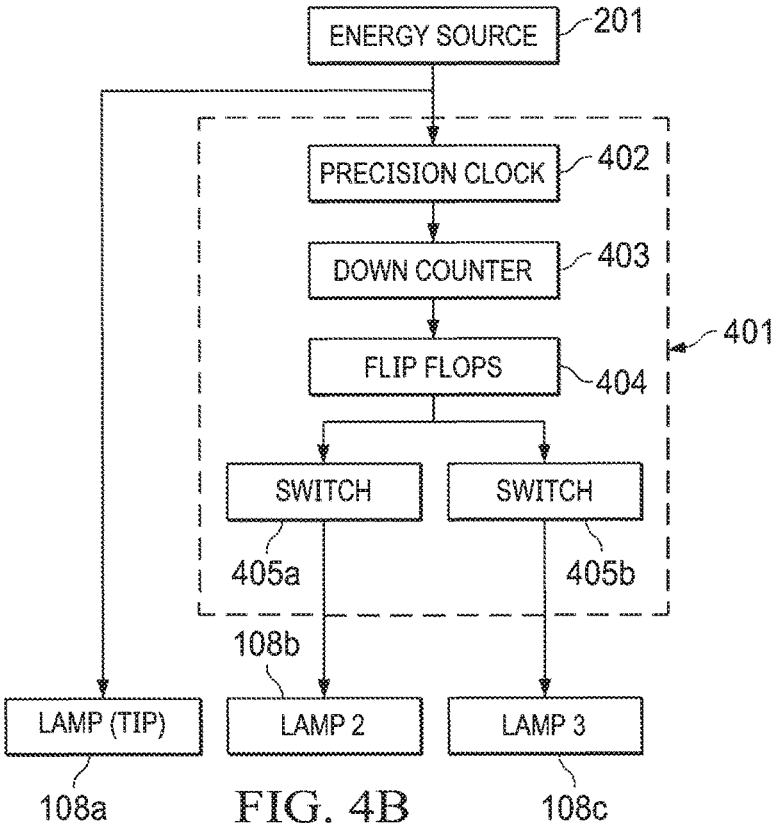
FIG. 4B is a more detailed block diagram of a representative XLF suitable for use in the system of FIG. 4*a*.

FIG. 4B is a block diagram of an exemplary XLF 401 suitable for use as XLF 401*a* and/or XLF 401*b* according to one embodiment of the present inventive principles. Similar to XLF 301 of FIGS. 3B and 3C, XLF 401 includes a precision clock signal generator 402, a down counter 403, and a pair of flip-flops 404. XLF 401, however, includes a pair of switches, with a switch 405*a* controlling the current through lamp 108*b* and a switch 405*b* controlling the current through lamp 405*c* such that lamps 108*b* and 108*c* alternately flash when the corresponding crossing gate 103 is down.

Figure 4C:
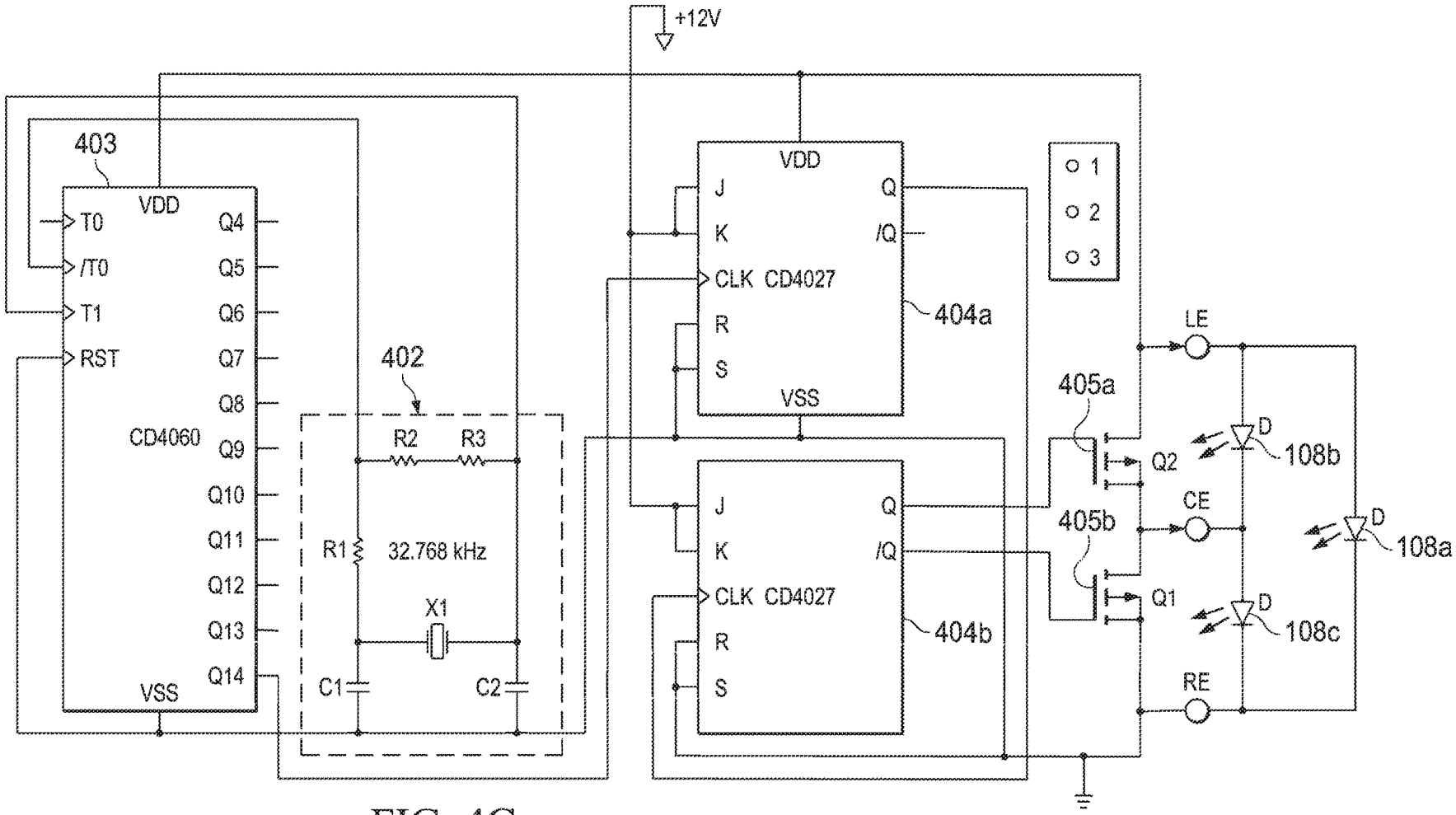
FIG. 4C is an electrical schematic diagram of a representative embodiment of the XLF of FIG. 4B.

An exemplary circuit suitable for implementing XLF 401 is shown in FIG. 4C. This embodiment of XLF 401 includes a precision clock signal generator 402, which generates a 32.768 kHz base frequency clock signal from a 32.768 kHz crystal. The base frequency of the 32.768 kHz clock signal is then divided-down by a 14-bit (CD4040) counter 403 to 1 Hz, which is the flashing frequency. (In alternate embodiments, a different base frequency maybe selected, along with a counter of a correspondingly different number of stages.) A first flip-flop 404*a* further divides the clock signal down to ½ Hz and a second flip-flop 404*b* divides the clock signal down to ¼ Hz. (In the embodiment of FIG. 4C, flip-flops 404*a* and 404*b* are J-K (CD4027) flip-flops, although in alternate embodiments other types of flip-flops may be used.)

The Q output of flip-flop 404*b* drives the gate of a FET 405*a* and the associated/Q output drives the gate of a FET 405*b*. When the corresponding gate 103 is down, and the XLF 401 is active, the Q and/Q outputs of flip-flop 404*b* cause the associated lamps 108*b* and 108*c* to alternately flash. In particular, when the Q output is high and the/Q output is low, FET 405*a* is on and FET 405*b* is off, such that current flows only through lamp 108*c*, which turns on. When the Q output is low and the/Q output is high, FET 405 is off and FET 405*b* is on, such that current flows only through lamp 108*b*, which turns on.

XLFs 401 operate in a similar matter to XLFs 301, with each circuit triggered by the application of power from energy source 201. As a result, the initial pulse of power from energy source 201 to XLF 401*a* and 401*b* synchronizes the flashing of flashing crossing gate lamps 108*a* and 108*b*.

In sum the embodiments of the present inventive principles ensure that failures are localized, such that even if some flashers become inoperable, other flashers will remain in operation. As a result, reliability and safety at highway crossing are enhanced.

Although the invention has been described with reference to specific embodiments, these descriptions are not meant to be construed in a limiting sense. Various modifications of the disclosed embodiments, as well as alternative embodiments of the invention, will become apparent to persons skilled in the art upon reference to the description of the invention. It should be appreciated by those skilled in the art that the conception and the specific embodiment disclosed might be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore contemplated that the claims will cover any such modifications or embodiments that fall within the true scope of the invention.

What is claimed is:

1. A railroad crossing warning circuit comprising:

a lamp;

a signal generator for generating a first signal of a selected frequency;

divider circuitry for dividing the selected frequency of the first signal to generate second signal having a flashing frequency, the divider circuitry comprising first and second complementary outputs; and a switch responsive to the second signal for controlling current flow through the lamp to selectively cause the lamp to flash at the flashing frequency.

2. The railroad crossing warning circuit of claim 1, wherein the lamp comprises a flasher lamp.

3. The railroad crossing warning circuit of claim 1, wherein the lamp comprises a crossing gate lamp.

4. The railroad crossing warning circuit of claim 1, wherein the railroad crossing warning circuit further comprises circuitry for selecting between the first and second complementary outputs to provide the second signal to the switch.

5. The railroad crossing warning circuit of claim 1, further comprising another lamp and another switch for controlling current flow through the another lamp, wherein the first complementary output is for controlling the switch and the second complementary output is for controlling the another switch such that the lamp and the another lamp flashes are out-of-phase.

6. The railroad crossing warning circuit of claim 1, wherein the divider circuitry comprises:

a down counter for dividing the selected frequency of the first signal to generate an intermediate signal of an intermediate frequency; and at least one flip-flop for dividing the intermediate frequency of the intermediate signal to generate the second signal at the flashing frequency.

7. The railroad crossing warning circuit of claim 6, wherein the at least one flip-flop comprises the first and second complementary outputs and the railroad crossing warning circuit further comprises circuitry for selecting one of the first and second complementary outputs for controlling the switch to set a flashing phase of the lamp.

8. The railroad crossing warning circuit of claim 1, wherein the switch comprises a field effect transistor.

9. The railroad crossing warning circuit of claim 1, wherein the signal generator comprises a crystal oscillator.

10. The railroad crossing warning circuit of claim 1, wherein operation of at least the signal generator and a down counter is triggered by an application of electrical power from a common energy source.

11. A railroad crossing flasher system comprising:

first and second lamps;

first control circuitry for controlling flashing of the first lamp comprising:

a first signal generator for generating a first base signal having a frequency;

a first frequency divider for dividing the frequency of the first base signal to generate a first flashing signal having a flashing frequency; and a first switch responsive to the first flashing signal for controlling current flow through the first lamp to selectively cause the first lamp to flash at the flashing frequency; and second control circuitry for controlling flashing of the second lamp comprising:

a second signal generator for generating a second base signal having a frequency;

a second frequency divider for dividing the frequency of the second base signal to generate a second flashing signal having the flashing frequency; and a second switch responsive to the second flashing signal for controlling current flow through the second lamp to selectively cause the second lamp to flash at the flashing frequency, wherein the first and second flashing signals are out-of-phase such that the first and second lamps alternately flash.

12. The railroad crossing flasher system of claim 11, wherein the first frequency divider comprises:

a down counter for dividing the frequency of the first base signal to generate an intermediate signal of an intermediate frequency; and at least one flip-flop for dividing the intermediate frequency of the intermediate signal to generate the first flashing signal at the flashing frequency.

13. The railroad crossing flasher system of claim 12, wherein the second frequency divider comprises:

a down counter for dividing the frequency of the second base signal to generate an intermediate signal of an intermediate frequency; and at least one flip-flop for dividing the intermediate frequency of the intermediate signal to generate the second flashing signal at the flashing frequency.

14. The railroad crossing flasher system of claim 13, wherein:

the at least one flip-flop of the first frequency divider comprises first and second complementary outputs, wherein the first complementary output is coupled to the first switch for controlling current flow through the first lamp; and the at least one flip-flop of the second frequency divider comprises first and second complementary outputs, wherein the second complementary output is coupled to the second switch for controlling current flow through the second lamp.

15. The railroad crossing flasher system of claim 13, wherein operation of the first control circuitry and the second control circuitry is triggered by application of energy from a common energy source such that flashing of the first and second lamps is synchronized.

16. A crossing gate lamp control system comprising:

first and second crossing gate lamps;

a signal generator for generating a first signal of a selected frequency;

divider circuitry for dividing the selected frequency of the first signal to generate first and second complementary output signals each at a flashing frequency;

a first switch responsive to the first complementary output signal for controlling current flow through the first crossing gate lamp to selectively cause the first crossing gate lamp to flash at the flashing frequency; and a second switch responsive to the second complementary output signal for controlling current flow through the second crossing gate lamp to selectively cause the second crossing gate lamp to flash at the flashing frequency alternately with the flashing of the first crossing gate lamp.

17. The crossing gate lamp control system of claim 16, wherein the divider circuitry comprises:

a down counter for dividing the selected frequency of the first signal to generate an intermediate signal of an intermediate frequency; and at least one flip-flop for dividing the intermediate frequency of the intermediate signal to generate the first and second complementary output signals at the flashing frequency.

18. The crossing gate lamp control system of claim 16, wherein the first and second switches comprise field effect transistors.

19. The crossing gate lamp control system of claim 16, wherein the signal generator comprises a crystal oscillator.

20. The crossing gate lamp control system of claim 16, wherein operation of at least the signal generator and the divider circuitry is triggered by application of energy from a common energy source.

* * * * *